US010773285B2

(12) United States Patent
Viviroli

(10) Patent No.: US 10,773,285 B2
(45) Date of Patent: Sep. 15, 2020

(54) STRAIGHTENING DEVICE FOR STRAIGHTENING CABLES

(71) Applicant: KOMAX HOLDING AG, Dierikon (CH)

(72) Inventor: Stefan Viviroli, Horw (CH)

(73) Assignee: KOMAX HOLDING AG, Dierikon (CH)

( * ) Notice: Subject to any disclaimer, the term of this patent is extended or adjusted under 35 U.S.C. 154(b) by 705 days.

(21) Appl. No.: 15/364,348

(22) Filed: Nov. 30, 2016

(65) Prior Publication Data

US 2017/0173652 A1 Jun. 22, 2017

(30) Foreign Application Priority Data

Dec. 21, 2015 (EP) ..... 15201628

(51) Int. Cl.
*B21D 3/02* (2006.01)
*B21B 37/58* (2006.01)
(Continued)

(52) U.S. Cl.
CPC ..... *B21B 37/58* (2013.01); *B21B 38/10* (2013.01); *B21C 51/00* (2013.01); *B21D 3/02* (2013.01); *B21F 1/02* (2013.01); *B65H 57/14* (2013.01); *B65H 2701/36* (2013.01); *D07B 5/12* (2013.01); *D07B 2201/2007* (2013.01); *D07B 2201/2012* (2013.01); *D07B 2201/2021* (2013.01);
(Continued)

(58) Field of Classification Search
CPC .... B21D 1/02; B21D 3/02; B21D 3/05; B21B 37/58; B21B 38/10; B21B 38/105; B21B 37/00; B21B 38/00; B21F 1/02
See application file for complete search history.

(56) References Cited

U.S. PATENT DOCUMENTS 5,115,653 A * 5/1992 Beisemann ..... B21D 3/02 72/10.4
5,676,010 A * 10/1997 College ..... B21D 3/05 72/162
(Continued)

FOREIGN PATENT DOCUMENTS

CN 201596726 U 10/2010
CN 102601273 A 7/2012
(Continued)

OTHER PUBLICATIONS

Translation; JP 62-089529A, Apr. 1987.*

*Primary Examiner* — Edward T Tolan
(74) *Attorney, Agent, or Firm* — William J. Clemens; Shumaker, Loop & Kendrick, LLP

(57) ABSTRACT

A straightening device for straightening cables includes two rows of rollers, an adjusting device for manually adjusting a distance between the rows of rollers, a measuring device for recording the distance between the rows of rollers, and an indicator device with which deviations of the actual value of the distance between the rows of rollers, determined by the measuring device, from a nominal value is visually indicated. The indicator device has two optical error indicating elements for indicating too high and/or too low an actual value compared with the nominal value of the distance, as well as an optical 'correct' indicating element for indicating that the actual value of the distance corresponds with the nominal value.

15 Claims, 3 Drawing Sheets

(51) Int. Cl.

| | |
|---|---|
| ***B21F 1/02*** | (2006.01) |
| ***B65H 57/14*** | (2006.01) |
| ***B21C 51/00*** | (2006.01) |
| ***B21B 38/10*** | (2006.01) |
| *D07B 5/12* | (2006.01) |

(52) U.S. Cl.

CPC ..... *D07B 2201/2044* (2013.01); *D07B 2205/3025* (2013.01); *D07B 2205/3067* (2013.01); *D07B 2207/4072* (2013.01); *D07B 2301/30* (2013.01); *D07B 2301/50* (2013.01); *D07B 2501/406* (2013.01)

(56) References Cited

U.S. PATENT DOCUMENTS

| | | | | |
|---|---|---|---|---|
| 7,475,581 | B2 * | 1/2009 | Farnik | B21D 1/02 700/122 |
| 2006/0277959 | A1 | 12/2006 | McKenna | |
| 2007/0227214 | A1 * | 10/2007 | Sauerland | B21B 37/16 72/7.6 |
| 2011/0315266 | A1 * | 12/2011 | Viviroli | B21F 1/02 140/147 |
| 2014/0216121 | A1 * | 8/2014 | Haverkamp | B21B 38/10 72/10.7 |

FOREIGN PATENT DOCUMENTS

| | | | | |
|---|---|---|---|---|
| CN | 202506786 | U | 10/2012 | |
| CN | 104942183 | A | 9/2015 | |
| DE | 1034576 | B | 7/1958 | |
| DE | 10259257 | A1 | 6/2004 | |
| DE | 102009007977 | A1 | 7/2009 | |
| EP | 2399856 | A1 | 12/2011 | |
| JP | 62-089529 | A * | 4/1987 | B21D 3/05 |
| JP | 2009172642 | A | 8/2009 | |

* cited by examiner

STRAIGHTENING DEVICE FOR STRAIGHTENING CABLES

FIELD

The invention relates to a straightening device for straightening cables and to a method of operating a straightening device of this type. The straightening device can form part of a cable processing machine. Such cable processing machines are used for the finishing of electrical cables. During the finishing of cables, cables can be cut to length, their insulation stripped and the cable ends crimped. The cable processing machines can also comprise bushing stations at which the stripped cable ends are fitted with bushings before crimping.

BACKGROUND

The cables, such as insulated strands or full conductors made of copper or steel, which are processed on a cable processing machine are usually supplied in drums, on rolls or as bundles, and for this reason after unrolling they are often bent to a greater or lesser degree and twisted. Straight aligned cables are important in order to be able to reliably carry out envisaged processing stages on the cable processing machine, such as stripping, crimping and, if applicable, fitting with plug housings. In order to align the cables as straight a possible they are generally pulled with the aid of the drives present in the cable processing machine through one or more straightening devices arranged at the inlet to the machine.

A comparable straightening device of this type is known, for example, from EP 2 399 856 A1. The straightening device comprises an upper series of rollers and a lower series of rollers which can be moved relative to each other in order to adjust the straightening parameters. The cable to be straightened is passed between the rollers of the two roller devices. The distance between the rollers can be set manually by means of an adjusting screw or by means of a rotary knob. For this the straightening device has a scale which is inscribed with various cable dimensions, or a sensor which measures the distance between the roller plates. When manually adjusting the distance between the rollers with these adjusting aids, the user alone is responsible for setting the straightening device correctly, which is prone to error. According to EP 2 399 856 A1 adjusting the distance between the rollers can alternatively also take place in fully automatically manner. For this, for example, the input mechanism for moving the upper row of rollers against the lower row of rollers is equipped with a motor drive. However, this variant is technically complex and cost intensive.

SUMMARY

It is therefore one aim of the present invention to avoid the drawbacks of the known art and, in particular, to create a straightening device of the type cited in the introduction with which the straightening parameters and, in particular, the distance between the rollers of the rows of rollers can be simply and effectively adjusted. The straightening device should be able to be adjusted reliably and precisely without high costs being incurred.

According to the invention, this aim is achieved by way of a straightening device comprising a first roller row with a plurality of rollers and a second roller row with a plurality of rollers. In the assembled state, both rows of rollers can be arranged as an upper and a lower row of rollers in the straightening device. The first row of rollers and the second row of rollers are arranged opposite each other and the cable can be passed through in a transporting direction alternately between the rollers, arranged one behind the other relative to the transporting direction, of the first row of rollers and second row of rollers. The straightening device also comprises an adjusting device for manually adjusting the distance between the rollers of the first row of rollers and the rollers of the second row of rollers and a measuring device for recording at least one straightening parameter. Said measuring device can, in particular, be a measuring device for recording the distance (as the first parameter for the straightening process) between the rollers of the first and the second rows of rollers. The distance between the roller rows can preferably be measured in the area of the outlet-side rollers of the opposing rows of rollers. For particular applications, however, it would also be conceivable additionally or alternatively to measure the distance at the inlet-side rollers or the inlet rollers and to take this into consideration for adjustment. The measuring device is or can be connected to a control device. For example, the measuring device can communicate via an analog interface or a digital interface with the control device, which can be a central machine control unit for a cable processing machine.

As the straightening device preferably also comprises an indicator device which is or can be connected to said control device and with which deviations of an actual value of the straightening parameter, determined by means of the measuring device, from a nominal value for the straightening parameter, for example, the roller distance, can be indicated visually, acoustically and/or tactilely, the straightening device can be adjusted simply, cost-effectively and without great effort. The indicator device makes it easier for the user to carry out manual adjustment of the straightening device in relation to the cable being processed. Incorrect settings which could result in poorly finished cable ends can thus be practically ruled out. For example, the nominal value for the roller distance can be automatically calculated from the cable ends of the cables to be processed. In the nominal value of the roller distance, the previously known or previously measured outer diameter of the cable can be taken into account. The nominal value can be stored as a mathematical function or as a table in the control device.

According to a first form of embodiment the indicator device has at least one error indicating element for indicating too high an actual value compared with the nominal value of the straightening parameter and/or to indicate too low an actual value compared with the nominal value of the straightening parameter. This arrangement makes for intuitive user control with regard to correct adjustment of the straightening device. Such an indicator device signals to the user whether and how he has to change the adjustment of the straightening device through operating the adjusting device.

The error indicating element can, for example, emit a beeping tone, the loudness, pitch and/or beep frequency changes depending on the magnitude of the deviation between the nominal and actual value. If the user incorrectly operates the adjusting device, for example if he moves the roller row in the wrong direction, the acoustic error indicating element can indicate this by more rapid beeping. The beeping becomes slower as the roller rows are relatively moved in the right direction. However, preferably the indicating element can comprises an optical error indicating element which can indicate too high and/or too low an actual value compared with the nominal value of the straightening parameter. The optical error-indicating element can comprise a lamp with one or more light-emitting diodes (LEDs).

Particularly preferably the lamp for the error-indicator is designed so that when necessary and/or on activation when the condition is fulfilled (i.e. actual value is too high or too low), it lights up red. For this purpose, red LEDs can be used for example. It is also conceivable to use one or more LEDs arranged behind a red translucent wall. The indicator device could also be designed in such a way that through varying the light intensity, flashing light and/or through varying the light color it intuitively indicates to the user in which directions the rows of rollers should be moved to adjust the distance.

The indicator device can also comprise an optical 'correct' indication element signaling that the actual value corresponds with the nominal value or that the actual value is within a predefined value range around the nominal value of the straightening parameter. As soon as the 'correct' indication element is activated the user is immediately informed that he has correctly adjusted the straightening direction at least in terms of the straightening parameter to be set and can now stop the adjusting procedure.

It is advantageous if the indicator device comprises two error indicating elements and a 'correct' indicating element, wherein the 'correct' indicating element can, for example, be arranged between the error indicating elements. Through this arrangement particularly simple manual adjustment of the straightening device is made possible for the user.

The error indicating elements and the 'correct' indicating element can be designed in such a way that on activation they light up in different colors. For example, the error indicating elements can light up in red and the 'correct' indicating element can light up in green. Alternatively to the three cited indicating elements the indicator device could also comprise a joint error and 'correct' indicating element that can emit both red and green light. In this case, if the user carries out correct adjustments the element previously lit up in red changes to green.

The indicator device can also comprise a digital display for numerically showing a straightening parameter value. For example, the digital display can show the actual value determined by the measuring device, such as the actual value of the measured distance between the rollers. However, the indicator device can also be designed so that the digital display additionally or at least alternatively indicates the nominal value assigned to the cable.

For recording the distance between the rollers of the first and second roller arrangement the measuring device can comprise a potentiometric path sensor. Other sensors for recording the distance between the rollers can of course also be used. The potentiometric path sensor has the advantage that it is cost-effective but nevertheless delivers good measuring results.

The measuring device can be connected to a memory unit with which the actual values and/or the deviations of the actual value from the nominal value of the relevant straightening parameter are recorded. The recording of deviations from the ideal position at the start of production is used for quality assurance.

If the measuring device is or can be connected to a control device, it can be advantageous if the control device is programmed in such a way that production operation is blocked if the actual value does not coincide with the nominal value, in other words if the straightening parameters are not correctly adjusted. Production operation is characterized in that in order to straighten the cable, the cable is pulled between the rollers of the first and the second row of rollers in order to be supplied to the relevant processing stations of the cable processing machine.

For the manual adjustment of the distance between the rollers of the first and the second row of rollers the adjusting device can have a rotary knob or an adjusting screw.

The adjusting device can also have devices for adjusting the angle between the roller lines defined by the rows of rollers. This angle can also be measured by means of appropriate sensors. The angle represents a second or further adjusting parameter which is taken into consideration or can be shown in or by the described or another indicating device.

A further aspect of the invention relates to a method of operating the aforementioned straightening device, more particularly using the previously described straightening device. With this method the straightening device can be simply adjusted and thus set up before the mass production of finished cables in the cable processing machine. In a first working step the cable to be straightened is introduced into an intermediate space between the rollers of the first row of rollers and the rollers of the second row of rollers arranged opposite the first row of rollers. The rows of rollers are then moved towards each other so that the cable is contacted by the rows of rollers in relation to the subsequent straightening process by way of the rollers. During the implementation of the relative movement to bring the rollers of the first row of rollers and the rollers of the second row of rollers into contact with the cable, manual operation of the adjusting device takes place. Thereafter the actual value of at least one straightening parameter is carried out by means of the measuring device. In the control device the actual value is compared with the nominal value for the relevant straightening parameter. If the comparison of the two values provides an inadmissible deviation between the actual value and the nominal value, the indicator device produces a visual, acoustic and/or tactile error signal to guide the user. The relative adjusting movement is continued and the measuring and comparison operations are repeated until the error signal of the indicator device disappears and/or until the indicator device generates a 'correct' signal to indicate that the actual value corresponds with the nominal value.

DESCRIPTION OF THE DRAWINGS

Further advantages and individual feature are set out in the following description of an example of embodiment and the drawings. In these.

DETAILED DESCRIPTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
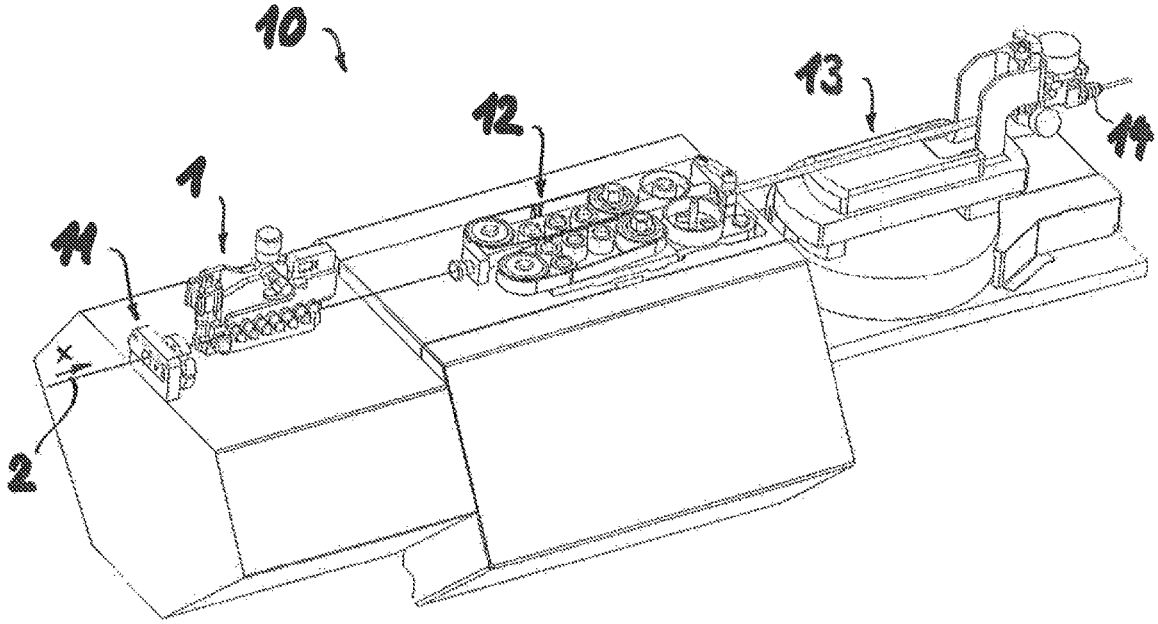
FIG. 1 shows a perspective view of a cable processing machine comprising a straightening device according to the invention for straightening cables.

FIG. 1 shows a cable processing machine 10 for the finishing of cables. In this case, as an example, the cable processing machine 10 is designed as a pivoting machine and has a pivoting unit 13 with a cable grip 14. To supply the cable ends to the (not shown) processing stations, such as a bushing station and crimping station, the pivoting unit 13 has to be turned about a vertical axis. A length cutting and insulation stripping station (also not shown) is generally arranged on the longitudinal axis of the machine. The cable processing machine 10 also comprises a feed unit with a cable conveying means 12, designed as a conveyor belt, which brings the cables along the longitudinal axis of the machine to the pivoting unit 13 in the transporting direction indicated by the arrow x. When supplying the cable, the cable 2 is pulled through a straightening device, designated 1, for straightening the cable 2.

With the cable processing machine 10, electrical cables, for example insulated strands or insulated solid wires of copper or steel are processed. The cables to be processed are provided in (not shown) drums, on rolls or as bundles. The cables 2 supplied to the cable processing machine 10 from drums, rolls or bundles are bent and twisted to a greater or lesser extent. The cable 2 must therefore be straightened, which is the purpose of said straightening device 1. Before the straightening device 1 there is a knot detecting device 11 to prevent unwanted cable knots reaching the cable processing machine. As the cable 2 is fed between the rollers of the lower row of rollers 3 and the upper row of rollers 4 it is alternately mechanically stressed by the rollers of the rows of rollers 3, 4 and thereby bent, through which the cable 2 is straightened.

By way of the adjusting device 5 the distance between the rollers of the first row of rollers 3 and the rollers of the second row of rollers can be adjusted. The correct adjustment of the straightening device 1 is essential for the quality of the cable subsequently processed in the cable processing machine 10. Particularly important is the correct adjustment of the distance between the rollers of the upper and lower row of rollers. Incorrect adjustments can have a negative effect on the alignment quality or straightness of the cable. Straightening devices 1 not adjusted correctly can result in imprecise insulation stripping length or can negatively affect the quality of the crimp connection.

Figure 2:
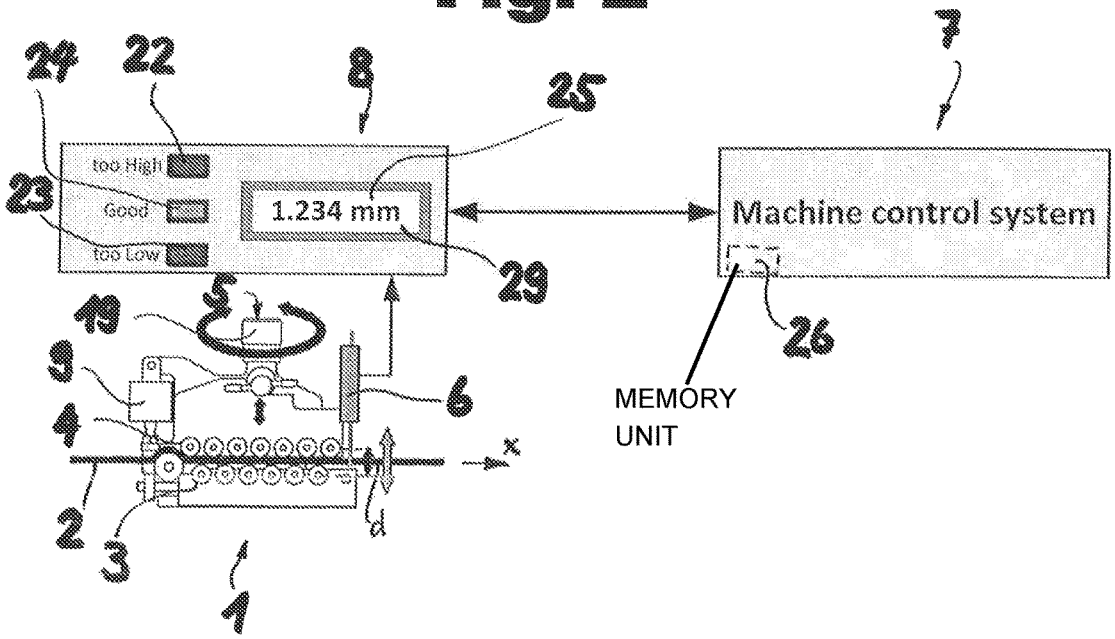
FIG. 2 shows a simplified view of the straightening device in FIG. 1.

In FIG. 2 the overall assembly of the straightening device 1 according to the invention for the above-described cable processing machine is shown. The straightening device 1 comprises the two rows of rollers 3 and 4. On turning the rotary knob 19 of the adjusting device 5 the rows of rollers 3 and 4 can be moved towards or away from each other. The direction of movement vertical to the longitudinal axis of the cable 2 or perpendicular to the transporting direction x is indicated by the double arrow. Through manual operation of the adjusting device 5 the distance d between the rollers of the upper and lower rows of rollers 3, 4 can visibly be changed.

The distance d is recorded by a measuring device 6 and can be numerically shown in an indicator device 8. However, in the present example of embodiment the example value "1.234 mm" is a determined value for the clear width between guide surfaces of the rollers of the upper and lower rows of rollers 3 and 4, when a cable or possibly a rigid pin for calibrating the straightening device 1 is clamped between the rollers of the parallel rows of rollers 3 and 4. It therefore approximately corresponds with the cable diameter of the cable 2 in FIG. 2 which would therefore be 1.234 mm. Other values can also be indicated by the digital display 25 of course. As has been stated above the indicator device 8 can also be designed in such a way that the actual value of the distance d between the rollers is shown in the digital display 25.

The measuring device 6 is connected to a control device 7, for example a central machine control unit of the cable processing machine. In the control device 7 the actual value of the distance d between the rollers determined by the measuring device 6 is compared with a nominal value. The nominal value of the distance between the rollers can be automatically calculated from the known cable data of the cable 2 to be processed, for example on the basis of the outer diameter of the cable 2. The nominal value of the distance between the rollers can also be stored as a mathematical function or as a table in the control device 7.

The distance d between the rollers is measured in the area of the outlet-side rollers 20.6 and 21.7 of the opposing rows of rollers 3 and 4. However, alternatively or additionally it would also be conceivable to measure the distance between the rollers on the inlet side. In this case the distance between the rollers 20.1 and 21.1 would be measured.

Deviations of the actual value from the nominal value of the distance d between the rollers can be visually indicated. For this the indicator device 8 has two error indicating elements 22 and 23 and one 'correct' indicating element 24. If the measured distance d between the rollers to too great the error indicating element 22 with the inscription "too high" lights up. If the measured distance d between the rollers to too small the error indicating element 23 with the inscription "too low" lights up. The two error indicating elements 22 and 23 are designed as lamp elements and each have, for example, a light-emitting diode which is red or at least lights up red (in short "LED"). The 'correct' indicating element 24 is arranged between the two error indicating elements 22 and 23. The 'correct' indicating element 24 is in the form of a lamp element and has a green or white light diode.

If the actual value corresponds with the nominal value for the distance d between the rollers the light diode for the 'correct' indicator is activated and lights up in green or white. Correspondence of the actual value with the nominal value is the state in which the straightening device is correctly adjusted. It should be noted that correspondence may also be present if the actual value is within a predefined nominal value range or band. Precise correspondence of two singular values is thus evidently not necessary. Thanks to this indicator device the user operating the adjusting device 5 can be intuitively guided with regard to adjusting the straightening parameters. Due to the error indicating elements 22 and 23 the user knows whether and in which direction the rows of rollers 3, 4 have to be adjusted through turning the rotary knob 19 of the adjusting device 5. 26 denotes a memory unit with which the measured data can be recorded.

It would also be conceivable to design the numerical display 25 in such a way that it can show different statuses, for example through different types of illumination or through the use of different colors. For example the digital display 25 can comprise LEDs which produce a background lighting as a function of the individual status. The frame 29 around the display field could also be illuminated. Depending on the status, i.e. if too high or too low an actual value in comparison with the nominal value for the distance between the rollers is present, this could be shown by the digital display 25 through the frame 29 of the display field lighting up in red.

The indicator device 8 could be further developed in such a way that in addition to visually showing deviations of the actual value determined by the measuring device from the nominal value it can also indicate them acoustically. It would also be conceivable to provide a vibration generator in the region of the rotary knob 19 of the adjusting device 5. Through vibration of the rotary knob, it could be indicated to the user for example that he/she is turning the knob in the wrong direction.

Figure 3:
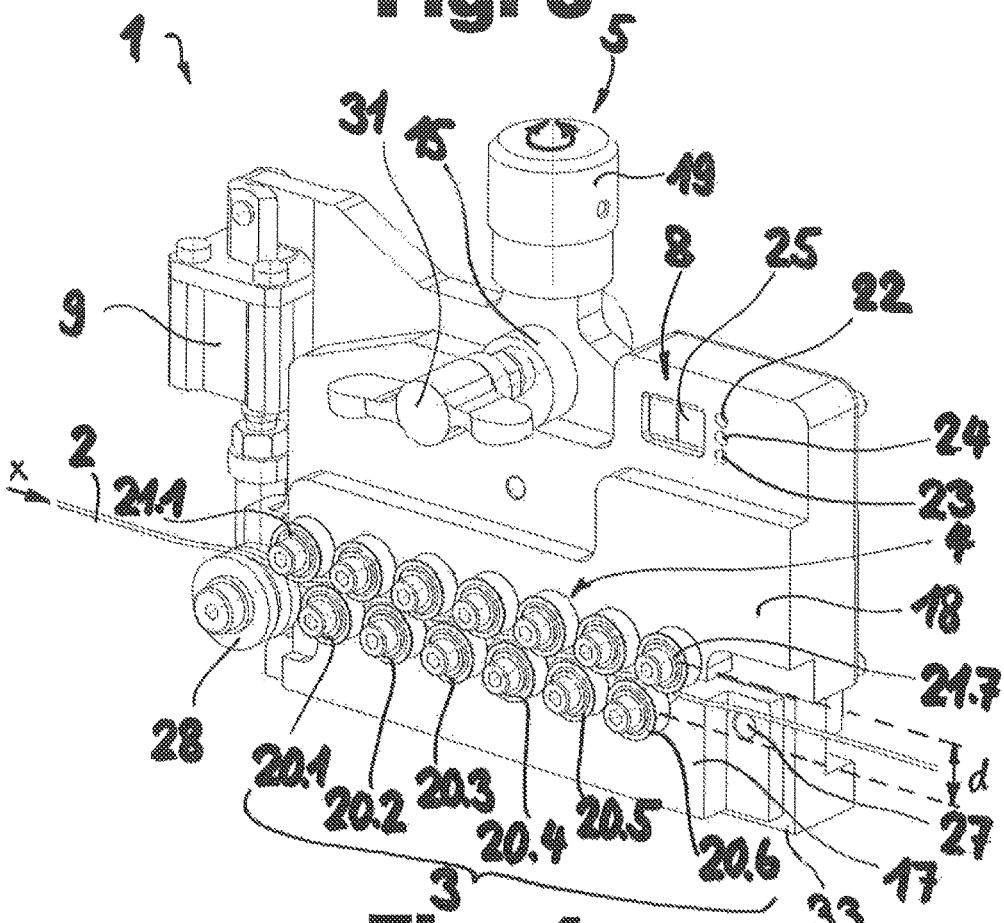
FIG. 3 shows a perspective view of the straightening device.
Figure 4:
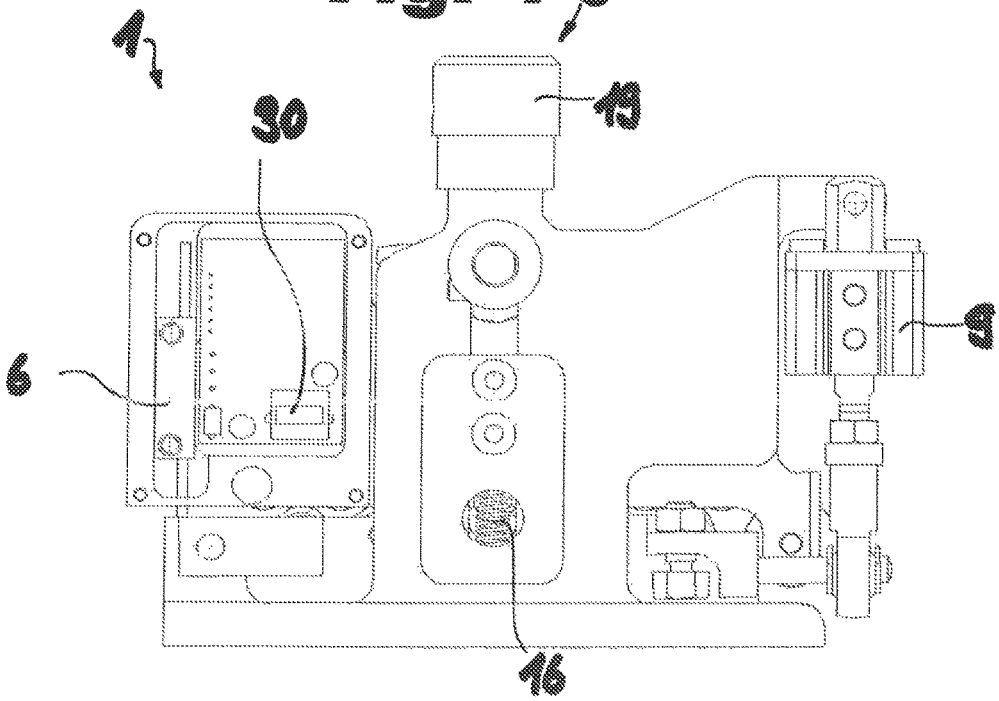
FIG. 4 shows a rear view of the straightening device in FIG. 3.
Figure 5A:
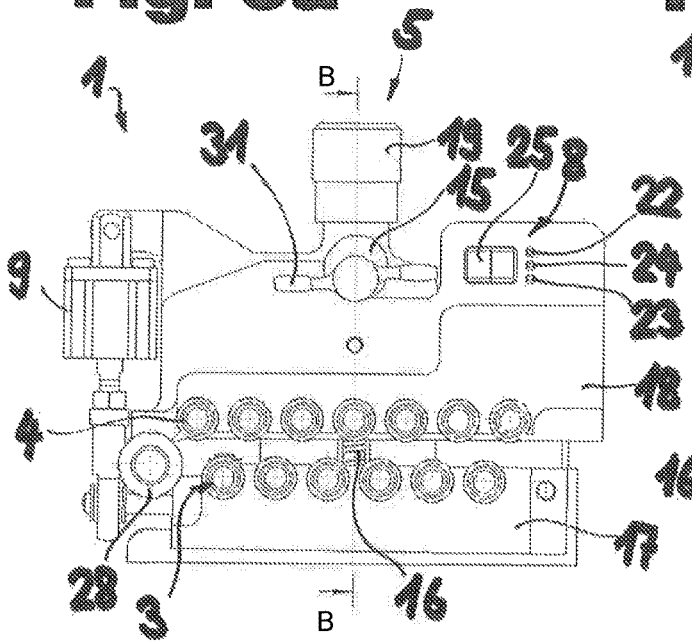
FIG. 5*a* shows a front view of the straightening device in the open state.
Figure 6A:
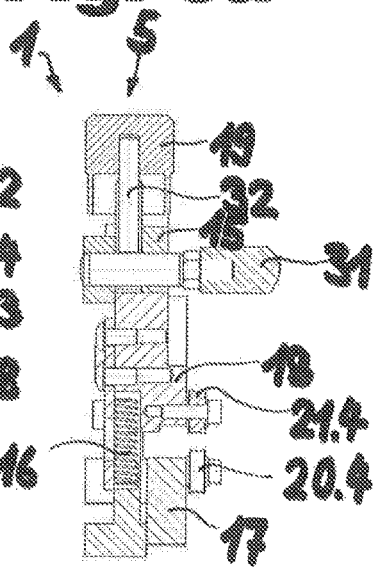
FIG. 6*a* shows a cross-sectional view of the straightening device in FIG. 5*a* (through line B-B according to FIG. 5*a*)
Figure 5B:
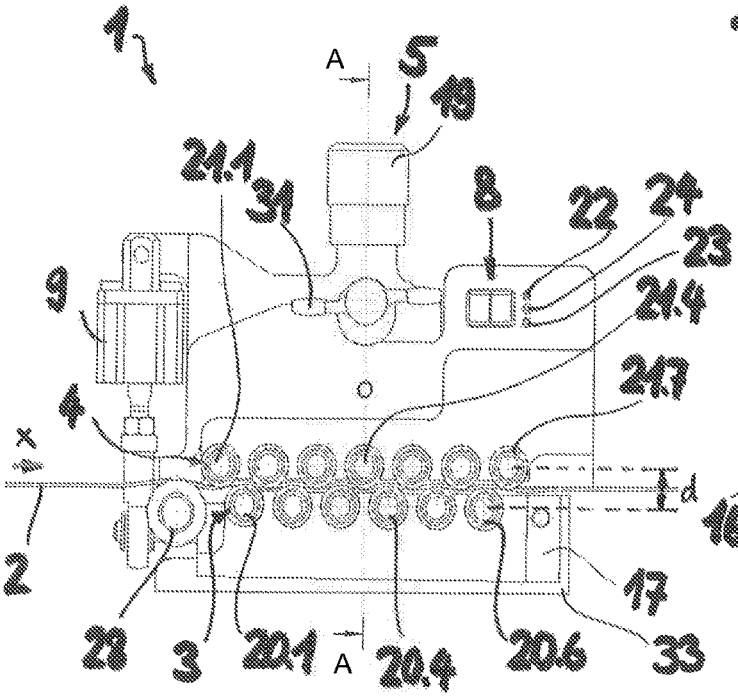
FIG. 5*b* shows the straightening device in FIG. 5*a* but in the active state.
Figure 6B:
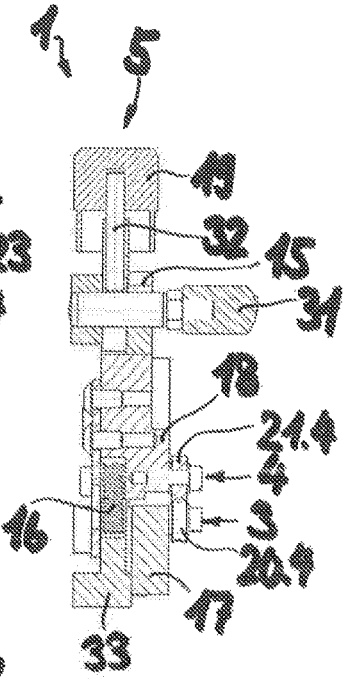
FIG. 6*b* shows a cross-section through the straightening device in the active state (through line A-A according to FIG. 5*b*).

Structural details of the design of the straightening device 1 can be seen in FIGS. 3 and 4 as well as in FIGS. 5 to 6*b*. In the present example of embodiment the straightening device 1 comprises six rollers of the lower row of rollers 3 arranged one behind the other in relation to the transporting direction x. The rollers are numbered 20.1 to 20.6. Arranged opposite the lower row of rollers 3 is the upper row of rollers 4 which has seven rollers. The first or front roller on the inlet side is numbered 21.1 and the last or rearmost roller on the outlet side is numbered 21.7.

Arranged in front of the rollers of roller rows 3 and 4 is a deflection roller 28 with a larger diameter at which the cable 2 undergoes the greatest bending. The relevant rollers 20.1 to 20.6 and 21.1 to 21.7 of the upper and lower rows of rollers 3, 4 respectively are each borne in a freely rotatable manner on roller plates 17 and 18 respectively. The roller plates 17 and 18 are borne in a displaceable manner relative to each other in the vertical direction or perpendicularly to the cable longitudinal axis x. In the present example of embodiment the upper row of rollers plate 18 can be displaced upwards or downwards by turning the rotary knob 19. So that the cable can be simply introduced into the straightening device 1, the straightening device 1 comprises a quick release lever 31 with an eccentric 15 for rapid opening. As a result of a guide perpendicular to the transporting direction x of the cable 2 the upper roller plate 18 can be guided on a base plate 33. The roller plate 18 is pressed into the open state by means of a pressure spring 16 (FIG. 4). The quick release lever 31, the eccentric 15 and the upper roller plate 18 can be simply and precisely moved by way of an adjusting screw or the rotary knob 19 via a spindle 32 (see FIG. 6*a*) perpendicularly to the longitudinal axis of the machine or to the transporting direction x towards or away from the roller plate 17 and the distance d between the rollers adjusted in this way. The roller lines, shown by the dashed lines, of the rollers 20.1 to 20.6 on the one side and the rollers 21.1 to 21.7 on the other side are more or less in parallel in the position according to FIG. 3. As long as only the adjusting device 5 is operated with the rotary knob 19, the roller lines remain in parallel with each other.

As the rollers on the inlet side of the straightening device exhibit the greatest straightening effect, a parallel alignment of the roller lines is often not desirable in operation. To adjust an angle (as a second straightening parameter—in relation to distance between the rollers as the first straightening parameter) of the roller lines, the straightening device 1 can be equipped with a pneumatic cylinder 9, as is described in EP 2 399 856 A1. The lower roller plate 17 is borne in a rotatable manner about a peripheral axis 27. In the present case the axis 27 is arranged next to the axis of rotation of the last roller 20.6 of the lower row of rollers 3. It would also be conceivable to allow the axis for the rotational movement of the roller plate 17 to coincide with the axis of rotation of the last roller 20.6. In this case the distance d between the rollers on the output side would not change when the lower roller plate 17 performs a slight rotational movement.

Through said rotational movement about the axis 27, the lower roller plate 17 with the first row of rollers 3 can thus be placed at an angle relative to the upper roller plate 18 with the second row of rollers 4. Here, on the input side the rollers press more strongly on the cable 2 which is being drawn through the straightening device 1. The straightening device 1 therefore exerts a diminishing straightening effect in a transporting direction x of the cable 2 from the first rollers 20.1, 21.1 to the last rollers 20.6, 21.7. The pneumatic cylinder 9 can be controlled by means of a valve. The pressure of the pneumatic cylinder 9 and thus the force acting on the cable 2 at the input side can be adjusted by means of a pressure regulator.

After the distance d between the rollers, the angle between the roller lines defined by the rollers of the roller rows 3, 4 is the second straightening parameter. This angle can be adjusted by way of the previously described pneumatic cylinder 9 or by means of an at least manually operable (not shown) adjusting device for pivoting the lower roller plate 17. Alternatively the angular position between the rows of rollers 3, 4 can be set to a fixed value, which is generally between 0° and 5°. For the positional fixing of this angular position, screws (not shown) could be used for example, which during pivoting of the lower roller plate can be guided in a corresponding elongated hole. The angle can also be recorded by a measuring device and this measuring device can be connected to the control device 7 and an indicator device in such a way that an incorrect angular position is signaled to the user. For example, after having set the correct distance between the rollers in a first adjusting phase, the user can adjust the angle by means of the adjusting device for pivoting the lower roller plate. Thanks to an appropriate indicator device, which can be designed in an analog manner to the already described indicator device assigned to the distance between the rollers, the angle can be adjusted easily and without great effort. An automatic embodiment in accordance with EP 2 399 856 A1, which sets comparatively high requirements and is therefore expensive, could be dispensed with.

In the rear view of the straightening device 1 according to FIG. 4 a plug socket 30 can be seen. The plug socket 30 can, for example, be a digital interface to the (not shown) control device. Via this interface the measuring device 6 for recording the distance between the rollers of the upper and lower rows of rollers communicates with the control unit. In FIG. 4 the pressure spring 16 can also be seen.

FIGS. 5*a* and 6*a* show the straightening device 1 in an open position. In this open position the rollers of the two rows of rollers 3, 4 are so far apart from each other that sufficient intermediate space is created through which the cable can be introduced. After introduction of the cable the rows of rollers are preferably first pushed against each other in a vertical direction by means of a quick release device comprising the quick release lever 31. In this closed position the rollers of the upper and lower rows of rollers 3, 4 extending in parallel to each other are close to the cable so the actual adjustment of the straightening device 1 can now be started. The user can thus turn the rotary knob 19 of the adjusting device 5 in the clockwise direction, through which the upper roller plate 18 with the upper row of rollers 4 is moved downwards against the lower row of rollers 3.

The user carries out this relative adjusting movement through manual operation of the adjusting device 5 until the rollers (20.1 . . . 20.6) of the first row of rollers 3 and rollers (21.1 . . . 21.7) of the second row of rollers 4 come into contact with the cable 2. The user can visually determine approximate contact. He then checks the indicator device 8. If the error indicating element 22 is lit up red the rows of rollers 3 and 4 are still too far apart from each other. In other words, the measured actual value for the distance d between the roller 20.1 . . . 20.6 and the rollers 21.1 . . . 21.7 of respectively the first and the second rows of rollers 3, 4 is too high compared with nominal value for the distance d between the rollers. By way of the indicator device 8 the user indirectly receives instructions to turn the rotary knob 19 further in the same direction of rotation. He continues this until the 'correct' indicating element 24 of the indicator device 8 lights up green. A 'correct' signal is generated which indicates that the actual value of the distance between the rollers coincides with the corresponding nominal value. If the user turns the rotary knob 19 for too long, the error indicating element 23 lights up in red as a result of the too small distance between the rollers.

The measurement for the distance d between the rollers is shown by way of a digital display 25, wherein the three LEDs of the error indicating elements 22, 23 and the 'correct' indicating element 24 signal to the user whether the straightening device 1 should be opened or closed in order to reach the required nominal value for the distance between the rollers. The operator turns the rotary knob 19 until on reaching the nominal value the green LED of the 'correct' indicating element 24 lights up. Thereupon the control unit 7 assigned to the machine control gives clearance for the production of the cable. The active setting, in which the straightening device 1 is correctly adjusted, is shown in FIGS. 5*b* and 6*b*. If required, after adjusting the distance between the rollers the angular position of the rows of rollers 3, 4 can be changed in the conventional manner through switching on or automatically operating the pneumatic cylinder 9. After appropriate rearrangement of the straightening device 1 the angular position of the rows of rollers 3, 4 can also be manually changed and adjusted in an analog manner as in the case of the distance between the rollers.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A straightening device for straightening cables comprising:

a first row of rollers and a second row of rollers positioned adjacent to the first row of rollers wherein the cable can be passed in a transporting direction between the first row of rollers and the second row of rollers;

an adjusting device for manually adjusting a distance between the first row of rollers and the second row of rollers;

an adjusting device for manually adjusting an angle between the first row of rollers and the second row of rollers;

a measuring device configured for measuring the distance between the first row of rollers and the second row of rollers at a location proximal inlet-side or outlet-side rollers in the first and second rows of rollers, measuring the angle between the first row of rollers and the second row of rollers, and recording the measured distance and the measured angle; and an indicator device for indicating a deviation of an actual value of the recorded distance from a nominal value of distance, a deviation of an actual value of the recorded angle from a nominal value of angle, or both, the indicating being at least one of visually, acoustically and tactilely.

2. The straightening device according to claim 1 wherein the indicator device has at least one error indicating element for indicating at least one of the actual value is too high compared with the nominal value and the actual value is too low compared with the nominal value.

3. The straightening device according to claim 1 wherein the indicator device has at least one optical error indicating element for indicating that the deviation is at least one of too high and too low.

4. The straightening device according to claim 3 wherein the at least one optical error indicating element is a lamp.

5. The straightening device according to claim 4 wherein the lamp is an LED.

6. The straightening device according to claim 3 wherein the indicator device has an optical 'correct' indicating element to indicate that the actual value corresponds with the nominal value.

7. The straightening device according to claim 1 wherein the indicator device includes two error indicating elements and a 'correct' indicating element, wherein the 'correct' indicating element is arranged between the two error indicating elements.

8. The straightening device according to claim 1 wherein the indicator device includes two error indicating elements and a 'correct' indicating element, and the error indicating elements and the 'correct' indicating element light up in different colors.

9. The straightening device according to claim 1 wherein the indicator device includes a digital display for numerically showing a straightening parameter value.

10. The straightening device according to claim 9 wherein the straightening parameter value is the deviation.

11. The straightening device according to claim 1 wherein the measuring device is a potentiometric path sensor.

12. The straightening device according to claim 1 wherein the measuring device is connected to a memory unit for recording in the memory unit at least one of the actual value and the deviation of the actual value from the nominal value.

13. The straightening device according to claim 1 wherein the measuring device is connected to a control device and the control device responds to the deviation representing the actual value not corresponding to the nominal value by blocking passing of the cable between the first and second rows of rollers.

14. The straightening device according to claim 1 wherein for manually adjusting the distance between the first and second rows of rollers, the adjusting device has a rotary knob or an adjusting screw.

15. A method of operating a straightening device comprising the steps of:

a) introducing a cable to be straightened between a first row of rollers and a second row of rollers;

b) executing a relative adjusting movement through manual operation of an adjusting device to bring the rollers of the first row of rollers and rollers of the second row of rollers into contact with the cable;

c) determining an actual value of two straightening parameters with a measuring device configured for measuring a distance between the first row of rollers and the second row of rollers at a location proximal inlet-side or outlet-side rollers and measuring an angle between the first row of rollers and the second row of rollers;

d) comparing actual values determined by the measuring device with nominal values of the straightening parameters;

e) if the comparison indicates an inadmissible deviation of the actual values from the nominal values, operating an indicator device to produce at least one of a visual, acoustic and tactile error indication; and f) in response to the error indication, repeating the steps b) through e) until the at least one error indication disappears and the indicator device generates a 'correct' indication to indicate that the actual values corresponds with the nominal values.

* * * * *